US005560131A

United States Patent [19]

Gibson

[11] Patent Number: 5,560,131

[45] Date of Patent: Oct. 1, 1996

[54] ADJUSTABLE, UPRIGHT DISPLAY HOLDER

[75] Inventor: Scott S. Gibson, Mercer Island, Wash.

[73] Assignee: Burke Gibson, Inc., Auburn, Wash.

[21] Appl. No.: 369,137

[22] Filed: Jan. 5, 1995

Related U.S. Application Data

[63] Continuation-in-part of Ser. No. 195,378, Feb. 14, 1994, abandoned.

[51] Int. Cl.[6] ..... G09F 15/00

[52] U.S. Cl. ..... 40/607; 40/611

[58] Field of Search ..... 40/606, 607, 611, 40/666; 248/218.4, 219.3

[56] References Cited

U.S. PATENT DOCUMENTS

| | | | |
|---|---|---|---|
| 461,324 | 10/1891 | Demorest | 40/611 |
| 1,559,010 | 10/1925 | Schwieger . | |
| 1,793,563 | 2/1931 | Schwartz . | |
| 1,866,723 | 7/1932 | Powers . | |
| 2,646,241 | 7/1953 | McLean . | |
| 2,787,433 | 4/1957 | Slavsky et al. . | |
| 3,327,415 | 6/1967 | Pearson | 40/666 |
| 3,529,798 | 9/1970 | Williams et al. . | |
| 3,729,847 | 5/1973 | Chandos | 40/607 X |
| 3,734,438 | 5/1973 | Kautz | 248/219.4 X |
| 3,969,838 | 7/1976 | Moore | 40/611 X |
| 4,574,507 | 3/1986 | Elliott | 40/607 |
| 4,616,799 | 10/1986 | Rebentisch . | |
| 4,805,331 | 2/1989 | Boggess et al. | 40/651 |
| 4,866,867 | 9/1989 | Clark | 40/642 |
| 4,881,707 | 11/1989 | Garfinkle . | |
| 4,909,464 | 3/1990 | Levine et al. . | |
| 4,957,256 | 9/1990 | Boeding . | |
| 5,012,603 | 5/1991 | Elcock | 40/607 X |
| 5,111,606 | 5/1992 | Reynolds | 40/642 |

*Primary Examiner*—Joanne Silbermann

*Attorney, Agent, or Firm*—Glenn D. Bellamy; David P. Campbell

[57] ABSTRACT

A display holder (10) having first (14) and second (16) central panels joined together along an outer side edge of each panel to form a main body section (12) that substantially is V-shaped in cross-section. The first and second central panels (14, 16) are joined in a manner allowing the panels to be angularly deflected. The first and second central panels (14, 16) also each include a back side edge (22), wherein angular deflection of the panels (14, 16) causes the back side edges (22) to move toward and away from each other. A mounting bracket (26) is provided at the back edge (22) of each central panel (14, 16) for securing the panels to lateral sides of an upright structural member. The mounting brackets (26) are each secured to the back edges (22) of the panels (14, 16) in a manner so that the mounting brackets (26) can be angularly deflected relative to the panels (14, 16). An outer frame strip (20) is provided at the junction (18) of the first and second central panels (14, 16), and a back edge frame strip (24) is provided at the back edges (22) of each central panel (14, 16). A top edge cap (32) and a bottom edge cap (34) are provided for enclosing the top edges (28) and bottom edges (30) of the display holder.

12 Claims, 4 Drawing Sheets

FIG. 7
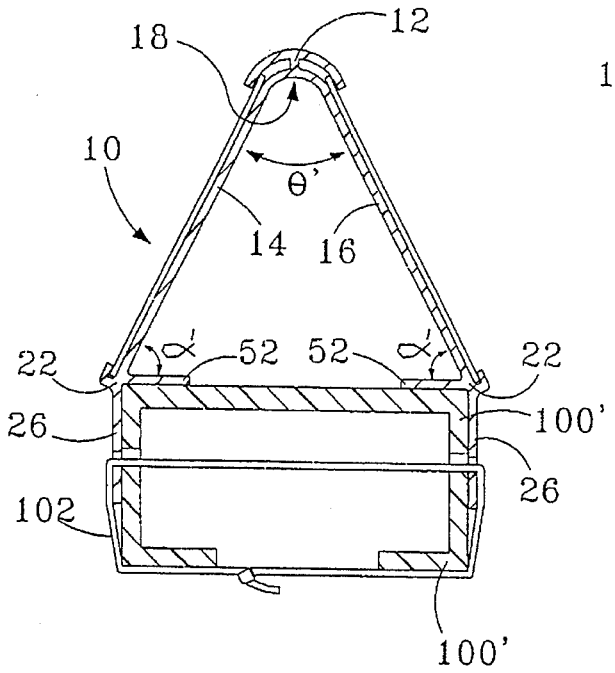
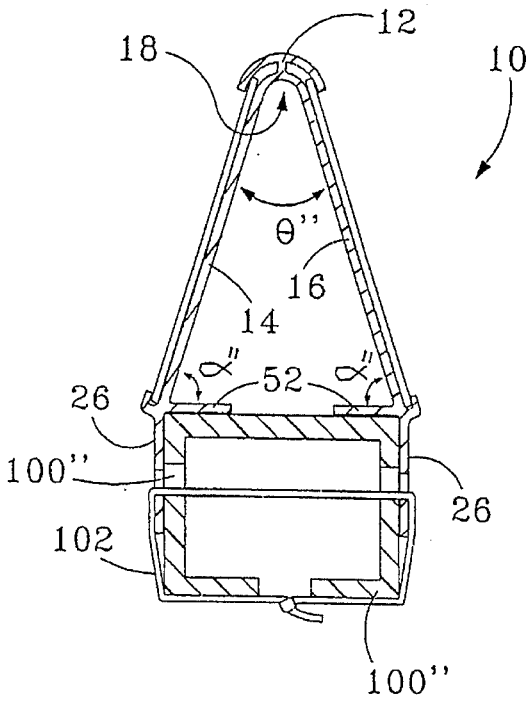
FIG. 8
FIG. 9
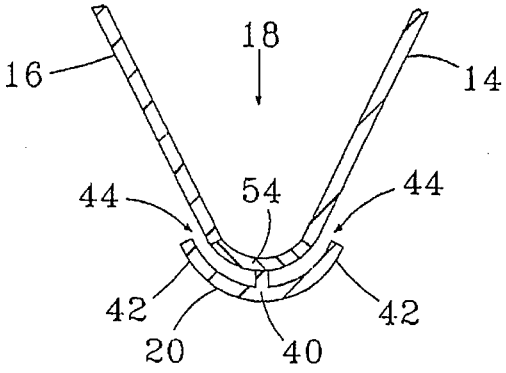

ADJUSTABLE, UPRIGHT DISPLAY HOLDER

RELATED APPLICATIONS

This application is a continuation-in-part of my application Ser. No. 08/195,378, filed Feb. 14, 1994 now abandoned.

TECHNICAL FIELD

This invention relates to display holders for sign boards, such as may be found in hardware stores, department stores, office supply stores, and various types of warehouse-type stores. More particularly, this invention pertains to display holders that have an adjustable mounting mechanism so that the display holder can be mounted to different sized structures.

BACKGROUND INFORMATION

For background purposes, the following patents show various types of signboards that are adapted to be mounted in a vertical orientation: U.S. Pat. No. 1,559,010, granted Oct. 27, 1925, to George B. Schwieger; U.S. Pat. No. 1,793,563, granted Feb. 24, 1931, to Eugene Schwartz; U.S. Pat. No. 1,866,723, granted Jul. 12, 1932, to Howard C. Powers; U.S. Pat. No. 2,646,241, granted Jul. 21, 1953, to Robert E. McLean; U.S. Pat. No. 2,787,433, granted Apr. 2, 1957, to Robert J. Slavsky and John R. Slavsky; U.S. Pat. No. 3,529,798, granted Sept. 22, 1970, to Donald C. Williams and Richard G. Growe; U.S. Pat. No. 4,574,507, granted Mar. 11, 1986, to Paul G. Elliott; U.S. Pat. No. 4,616,799, granted Oct. 14, 1986, to Hugo E. Rebentisch; U.S. Pat. No. 4,805,331, granted Feb. 21, 1989, to Charles H. Boggess and Richard G. Krautsack; U.S. Pat. No. 4,866,867, granted Sept. 19, 1989, to Kenneth H. Clark; U.S. Pat. No. 4,881,707, granted Nov. 21, 1989, to Benjamin L. Garfinkle; U.S. Pat. No. 4,909,464, granted Mar. 20, 1990, to Stanley L. Levine and Lee R. Wiese; U.S. Pat. No. 4,957,256, granted Sept. 18, 1990, to Mary B. Boeding; and U.S. Pat. No. 5,111,606, granted May 12, 1992, to Randy B. Reynolds. These patents should be carefully studied for the purpose of putting the present invention into proper perspective.

Also, my prior U.S. patent application, Ser. No. 08/023,694, filed Feb. 26, 1993, discloses a vertically-oriented display holder that can pivot or flex horizontally should the display holder get struck or bumped.

An object of the present invention is to provide a display holder apparatus of the character of these prior patents and patent applications and which is adjustable so that it can be secured to upright structural members of different sizes.

It is also an object of the present invention to provide a vertically-oriented display holder that is simple and practical in construction, relatively inexpensive to manufacture and maintain, which is rugged and durable, and which otherwise is well adapted for the purposes for which the apparatus is intended.

DISCLOSURE OF THE INVENTION

Briefly described, the display holder of the present invention comprises first and second central panels joined together along an outer side edge of each panel to form a main body section that substantially is V-shaped in cross-section. The first and second central panels are joined in a manner allowing the panels to be angularly deflected. The first and second central panels also each include a back side edge, wherein angular deflection of the panels causes the back side edges to move toward and away from each other, thereby changing the distance between the back edges. The first and second central panels each are adapted to receive a display. A mounting bracket extends from the back edge of each central panel. The mounting bracket secures the panels to lateral side edges of an upright structural member. The display holder can be secured to upright structural members of varying widths by angularly deflecting the central panels to change the spacing between the mounting brackets to correspond to the lateral width of the upright structural member.

The mounting brackets each are secured to the back edges of the panels in a manner so that the mounting brackets can be angularly deflected relative to the panels. In this manner, the mounting brackets can be aligned with the lateral sides of the upright structural member regardless of the width of the upright structural member.

Preferably, the mounting brackets and the central panels are formed as an integral unit and from a material that has sufficient flexibility to allow angular deflection between the mounting brackets and the back edges of the panels, and between the two panels. Various types of stuctural plastic material well known in the art are suitable for this purpose.

According to an aspect of the invention, an outer frame strip is provided at the junction of the first and second central panels. The outer frame strip provides a frame portion along the outer edges of the panels. Also, a back edge frame strip is provided at the back edges of each central panel. The back edge frame strip provides a frame portion along the back edges of the panels. The outer frame strip and the back edge frame strips define a channel on each central panel for receiving a display.

Preferably, the outer frame strip and the back edge frame strips form slots along the outer and back edges of the panels. The slots receive the side edges of displays and hold the displays on the panels.

According to another aspect of the invention, top and bottom edge caps are provided that are adapted to mount to the top and bottom edges, respectively, of the first and second central panels. The top and bottom edge caps provide a top frame portion and a bottom frame portion, respectively, for the panels.

Preferably, the top and bottom edge caps are adapted to be press-fitted onto the top and bottom edges, respectively, of the panels. Also, the top and bottom edge caps each are sufficiently flexible to accommodate angular deflection between the central panels. In a preferred embodiment, the top and bottom edge caps each are V-shaped to correspond with the cross-sectional shape of the central panels, and the junctions of the V-shaped top and bottom edge caps are formed of a flexible material and the arms of the top and bottom edge caps are made of a rigid material.

According to another aspect of the invention, the top edge cap has a rounded top surface and the bottom edge cap has a rounded bottom surface. Also, the junctions of both top and bottom edge caps are rounded. This design provides a display holder without any exposed sharp edges, which design presents an attractive display.

These and other advantages and features will become apparent from the following detailed description of the best mode for carrying out the invention and the accompanying drawings, and the claims, which are incorporated herein as part of the disclosure of the invention.

BRIEF DESCRIPTION OF THE DRAWINGS

In the figures, like reference numerals refer to like parts throughout the several views, wherein:

FIG. 7 is a schematic sectional view of the main body section of the display holder of FIG. 1, with the display holder secured to an upright column by means of a cable clamp, and the central panels of the display holder being shown angularly deflected with respect to each other by a large angle;

FIG. 8 is a view similar to FIG. 7, showing the central panels of the display holder angularly deflected with respect to each other by a smaller angle, and with the display holder secured to an upright column that has a smaller lateral dimension than the upright column of FIG. 7; and FIG. 9 is an enlarged fragmentary sectional view showing a preferred form of a co-extruded flexible hinge.

BEST MODE FOR CARRYING OUT THE INVENTION

Figure 1:
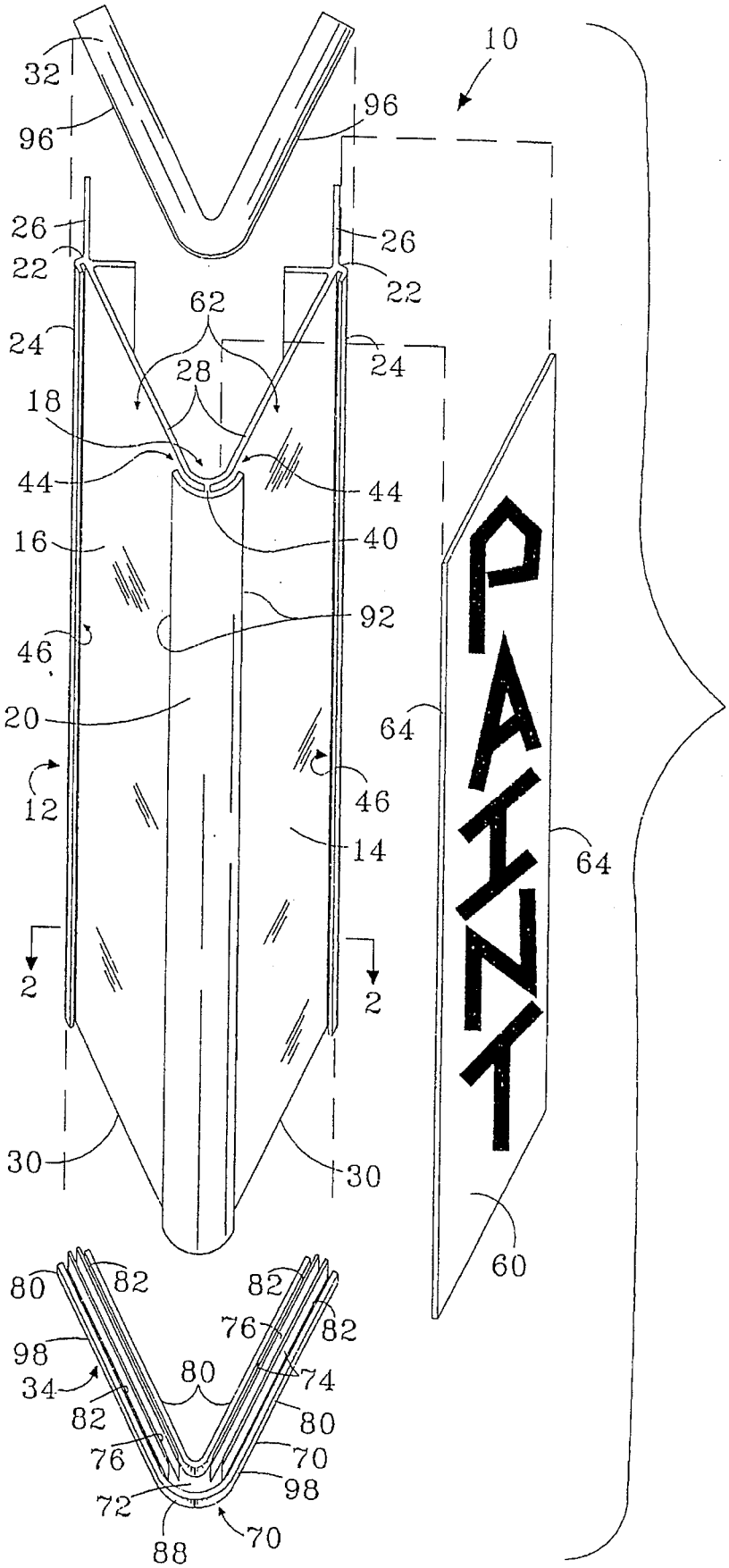
FIG. 1. is an exploded pictorial view of the display holder of the present invention.

In FIG. 1, a display holder 10 is shown constructed in accordance with a preferred embodiment of the present invention. Display holder 10 includes a main body section 12 comprising a first central panel 14 and a second central panel 16. Central panels 14 and 16 are joined at their outer edges at junction 18. An outer frame strip 20 is secured to central panels 14, 16 along junction 18. At the back edges 22 of central panels 14, 16, back edge frame strips 24 are secured. Mounting brackets 26 extend rearwardly from the back edges 22 of panels 14, 16. As shown in FIG. 1, the top edges 28, as well as the bottom edges 30, of panels 14, 16 form a "V" shape. A top edge cap 32 is adapted to fit over top edges 28 of panels 14, 16, and bottom edge cap 34 is adapted to fit over the bottom edges 30 of panels 14, 16. Top and bottom edge caps 32, 34, likewise, are V-shaped.

Figure 2:
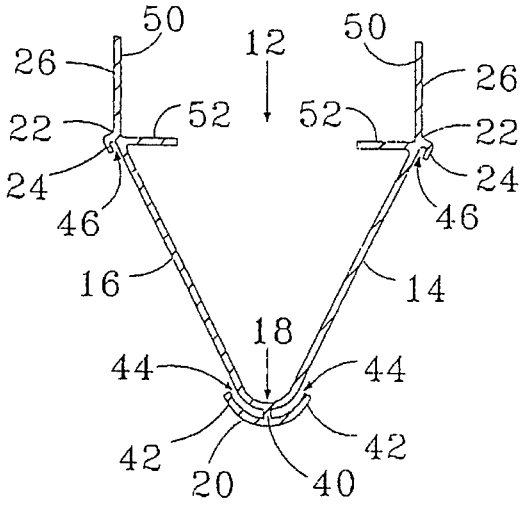
FIG. 2 is a cross-sectional view of the main body section of the display holder, taken along the line 2—2 of FIG. 1.

Referring to FIG. 2, central panels 14, 16 meet at junction 18, which junction is curved or rounded. Outer frame strip 20 extends outwardly from junction 18 and includes a central rib 40 and a pair of laterally-projecting curved fins 42. Fins 42 curve around junction 18 so as to form slots 44 of relatively uniform width. At the back edges 22 of panels 14, 16, back edge frame strips 24 extend first laterally outwardly from panels 14, 16, and then curve forwardly to form slots 46. Mounting brackets 26 are L-shaped and each include a side flange 50 and a front flange 52. Flanges 50, 52 meet at back edges 22.

Preferably, the main body section 12 of display holder 10, including panels 14, 16, strips 20, 24, and brackets 26, is an extrusion made from a structural plastic material that has sufficient rigidity to support various types of signboards, yet also is flexible enough to allow junction 18 to flex so that central panels 14, 16 can be angularly deflected toward and away from each other, and so that mounting brackets 26 can be angularly deflected with respect to central panels 14, 16. Flexibility allows display holder 10 to be secured to upright structral members, such as legs, posts, beams, etc., that have different lateral dimensions or widths.

Referring to FIG. 9, an alternate preferred embodiment is shown in which the junction 18 between central panels 14, 16 is formed of a relatively more flexible elastomeric material 54, thereby forming an elongated hinge. Preferably, this flexible portion 54 is co-extruded through a suitable die as the main body section 12 is formed. In order to provide appropriate structural integrity, it is preferred that the central panels 14, 16, outer frame strip 20 and central rib 40 are co-extruded of a relatively rigid plastic material. This structure provides a display holder 10 with an optimum degree of flexibility so as to be widely adjustable to adapt to mounting on vertical members of varying widths.

As shown in FIG. 1, display holder 10 is adapted to support a signboard 60 with the signboard 60 lying flush against each of the central panels 14, 16. Only one signboard 60 is shown in FIG. 1, however, preferably a second signboard is carried against central panel 16.

Outer frame strip 20 and back edge frame strips 24 define a channel 62 on each central panel 14, 16 for receiving a signboard 60. The outer side edge portions 64 of signboard 60 are received within slots 44, 46 defined by outer frame strip 20 and back edge frame strips 24. Preferably, the width of slots 44, 46 is slightly less than the width or depth of signboard 60, so that a friction fit holds edge portions 64 of signboard 60 within slots 44, 46. However, slots 44, 46 can be greater in size than the width of signboard 60, wherein top edge cap 32 and bottom edge cap 34 function to hold signboard 60 on its central panel 14 or 16. A plastic or cardboard signboard, for example, is slid endwise through each channel 62, with its opposite edge portions 64 within slots 44, 46.

Figure 3:
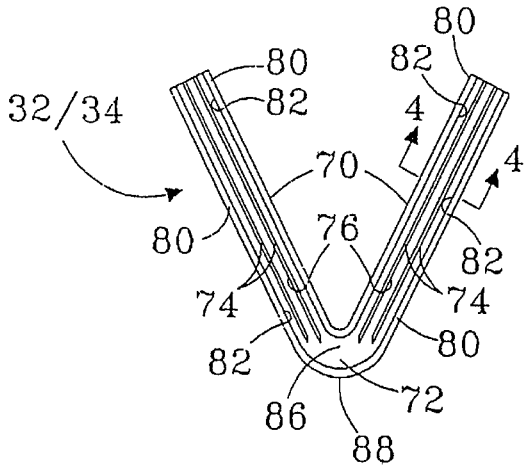
FIG. 3 is a plan view of either the top edge cap or the bottom edge cap of the display holder of FIG. 1.
Figure 4:
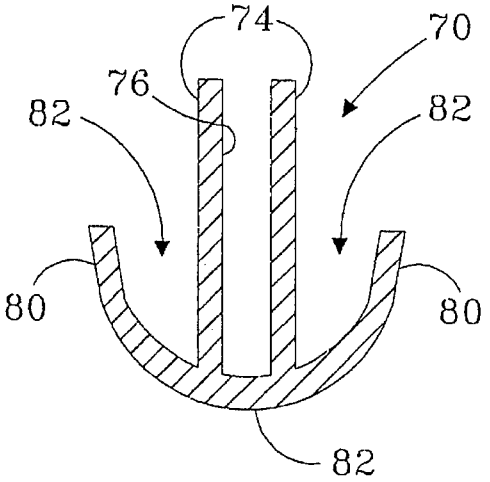
FIG. 4 is a cross-sectional view of an arm of either the top edge cap or the bottom edge cap, taken along the line 4—4 of FIG. 3.

FIG. 3 is a plan view of either the bottom edge cap 34 or the top edge cap 32. Edge caps 32, 34 are identical in design. Each edge cap 32, 34 includes a pair of arms 70 that meet at a junction 72. Arms 70 are angularly displaced from each other to form a V-shape design corresponding to that of central panels 14, 16. As shown in FIG. 4, each arm 70 includes a pair of raised parallel ribs 74 that form a slot 76 therebetween. Arms 70 also include a rounded, semi-annular base 78 that has a pair of frame extensions 80, which define slots 82. In FIG. 3, it is shown that ribs 74 terminate at junction 72. This creates a gap 86 between the ends of ribs 74. Junction 72 includes a rounded nose 88.

As can be seen in FIG. 1, with respect to bottom edge cap 34, when bottom edge cap 34 is press-fitted onto bottom edges 30 of main body section 12, ribs 76 mate with the bottom edges 30 of panels 14, 16 so that edges 30 are received within slots 76. Back edge frame strips 24 are received in outer slots 82, as is outer frame strip 20. The central rib 40 of outer frame strip 20 is received in gap 86 between the ends of ribs 76. In this manner, the bottom edge cap 34, and for that matter, top edge cap 32, close off the bottom edges 30 and top edges 28 when press-fitted thereto so as to provide a display holder 10 without any exposed sharp edges.

When the display holder 10 is assembled with signboards 60 carried within channels 62, outer frame strip 20 provides a frame portion 92 along the outer edges of central panels 14, 16. Back edge frame strips 24 provide a frame portion along the back edges 22 of panels 14, 16. The top and bottom edge caps 32, 34 provide a top frame portion 96 and a bottom frame portion 98, respectively, for the panels 14, 16. Accordingly, with a signboard 60 received within each of the channels 62 and the end caps 32, 34 snap-fitted onto the edges 28, 30 of main body section 12 of display holder 10, the signboards 60 are completely framed by the frame strips and edge strips. Such a design presents an attractive display.

Preferably, top and bottom edge caps 32, 34 are injection molded from a suitable structural plastic material. It is desirable for the junctions 72 of edge caps 32, 34 to have sufficient flexibility to allow arms 70 to angularly deflect in unison with the angular deflection that can be accomplished between central panels 14, 16. A preferred method of achieving this flexibility is to inject a flexible structural plastic material into the region of junction 72, which structural plastic material will retain its flexibility when cured, and to inject a more rigid structural plastic material into the regions of arms 70, so that arms 70, when cured, are sufficiently rigid to facilitate their being snap-fitted onto the edges of panels 14, 16 and to help resist any bending of panels 14, 16. The flexible structural plastic material injected into region 72 will bond to the rigid structural plastic material injected into the regions of arm 70 so that a uniform physical edge cap is constructed having a flexible junction 72 and rigid arms 70.

Figure 5:
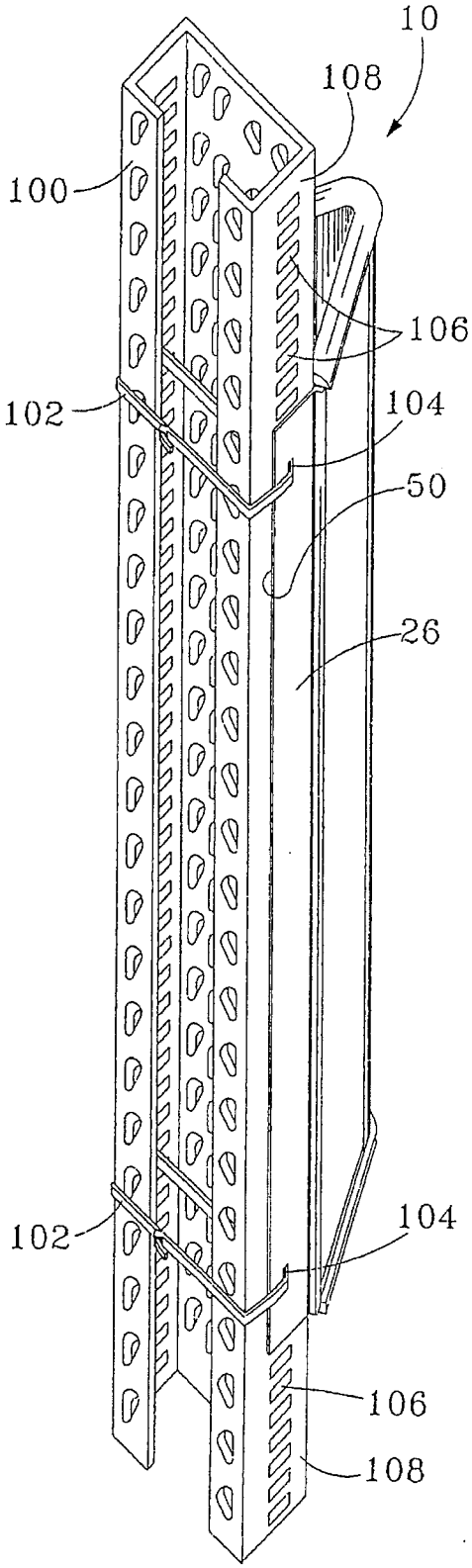
FIG. 5 is a pictorial rear view of the display holder of FIG. 1 secured to an upright column.
Figure 6:
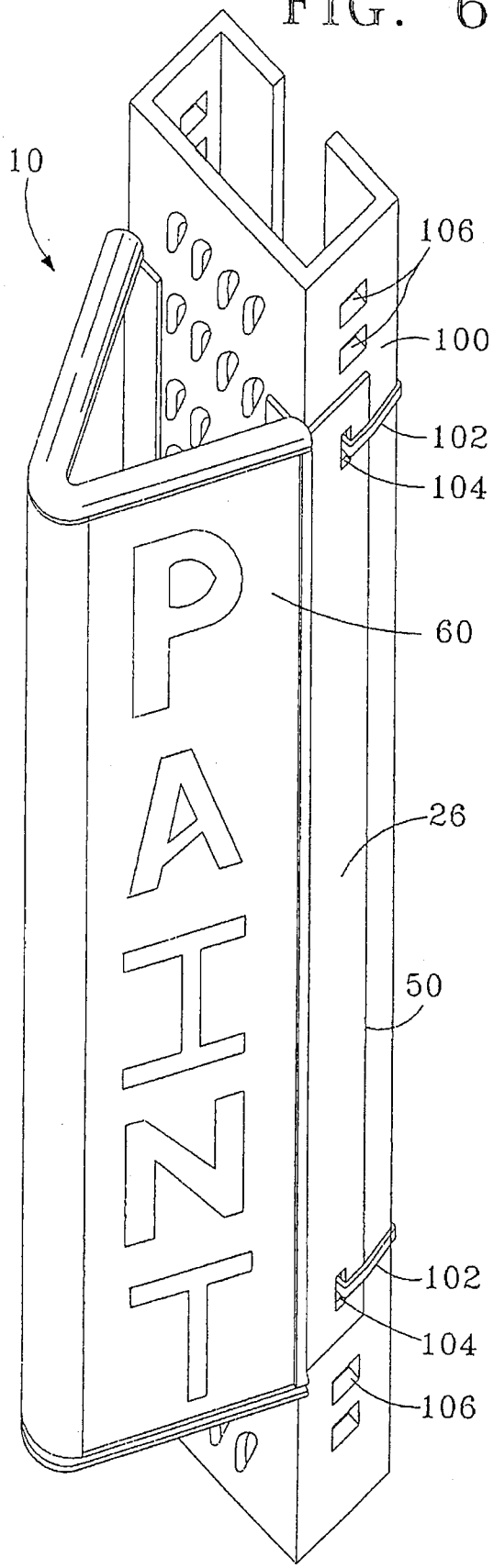
FIG. 6 is a pictorial front view of the display holder of FIG. 1 showing the display holder mounted to an upright column.

In FIGS. 5 and 6, display holder 10 is shown mounted to an upright column or structural member 100. Common cable clamps 102 extend through openings 104 in the side flanges 50 of mounting brackets 26 and through corresponding openings, such as openings 106, in the lateral sides 108 of upright column 100. The design of mounting brackets 26 allows the display holder 10 to be mounted to an upright column 100 in a manner so that the central panels 14, 16 and the signboards 60 held thereagainst extend away from upright column 100 and are exposed horizontally in two different directions. When utilized in a hardware store, department store, grocery store, or various types of warehouse-type stores, the vertically-oriented display holder 10 provides an easily-recognizable sign for directing customers to particular products.

In the various types of stores discussed above, especially warehouse-type stores and hardware stores, upright column 100 typically is part of the shelving structure that lines the aisles of the store and carries products displayed for sale. However, upright column 100 could be a post that supports the roof of the building, a leg of a table, or a beam exposed from a wall. The upright column 100 can vary in lateral dimension depending on the upright structure to which the display holder 10 is secured. Accordingly, the display holder 10 is provided with sufficient flexibility so that it can be adjusted in width with its mounting brackets spaced a distance corresponding to the lateral dimensions of different size structural members.

FIG. 7 illustrates the display holder 10 secured to a wide upright column 100', and FIG. 8 shows the display holder 10 10. secured to a narrower upright column 100". In FIG. 7, the angle θ' between central panels 14, 16 is greater than the angle θ" between panels 14, 16 in FIG. 8. Angle α' between panels 14, 16 and front flanges 52 of FIG. 7 is smaller than angle α" between panels 14, 16 and flanges 52 in FIG. 8. The choice of material for extruding the main body section 12 of display holder 10 provides the necessary flexibility at junction 18 to change the angle θ between the central panels 14, 16. Alternatively, the previously-described co-extruded portion 54 will provide optimum flexibility at the junction 18. In addition, the choice of material also provides the necessary flexibility between mounting brackets 26 and back edges 22 of central panels 14, 16 to accommodate different angles α' and α" between the front flange 52 of mounting brackets 26 and central panels 14, 16. As previously discussed, and not shown in FIGS. 7 and 8, the top and bottom edge caps also have sufficient flexibility to angularly deflect along with the angular deflection between central panels 14, 16.

Also shown in FIGS. 7 and 8 in more detail are the cable clamps 102 that secure mounting brackets 26 to the upright columns 100. If it is desired to reposition a display holder higher or lower along upright column 100, or to transfer display holder 10 to a different upright column, cable clamps 102 are cut and new, unused cable clamps are used to re-secure the mounting brackets 26 when the display holder 10 is repositioned. Alternatively, other arrangements can be utilized to secure brackets 26 to upright column 100, such as screws, Velcro, glue, clips, etc. In addition, it should be noted that mounting brackets 26 can also be semi-circular or arcuate to match a rounded upright column, or could be any shape that accommodates other designs for an upright column.

Accordingly, it can be seen that an improved, vertically-oriented display holder is now provided that is adjustable to be secured to upright columns of different sizes and which is simple in design, inexpensive to manufacture, durable, and easy to install and re-install to accommodate the product layout of a given store.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalence and reversal of parts.

What is claimed is:

1. A display holder adapted to be vertically mounted to an upright structural member, comprising:

first and second central panels joined together along and outer side edge of each panel to form a main body section that is substantially V-shaped in cross-section, the first and second central panels being joined in manner allowing the panels to be angularly deflected, the first and second central panels also each including a back side edge, wherein first and second central panels joined together along and outer side edge of each panel to form a main body section that is substantially V-shaped in cross-section, the first and second central panels being joined in manner allowing the panels to be angularly deflected, the first and second central panels also each including a back side edge, wherein angular deflection of the panels causes the back side edges to move toward and away from each other, thereby changing the distance between the back edges, the first and second central panels each adapted to receive a display, an outer frame strip at the junction of the first and second central panels and providing a frame portion along the outer edges of the panels, and a back edge frame strip at the back edge of each central panel and providing a frame portion along the back edges of the panels, the outer frame strip and the back edge frame strips defining a channel on each panel for receiving a display, and, a mounting bracket at the back edge of each central panel for securing the panels to lateral sides of the upright structural member, wherein the mounting brackets and both central panels are formed as an integral unit and from a material that has sufficient flexibility to allow angular deflection between the mounting brackets and the back edges of the panels,and between the two panels, and whereby the display holder can be secured to upright structural members of varying widths by angularly deflecting the central panels to change the spacing between the mounting brackets to correspond to the lateral width of the upright structural member, and further comprising a strip of relatively flexible material joining together the first and second panels, the first and second panels being made of relatively more rigid material.

2. The display holder of claim 1, wherein the mounting brackets each are secured to the back edges of the panels in a manner so that the mounting brackets can be angularly deflected relative to the panels, whereby the mounting brackets can be aligned with the lateral sides of the upright structural member regardless of the width of the upright structural member.

3. The display holder of claim 2, wherein the mounting brackets each comprise an L-shaped bracket having a side flange for mating with a lateral side of the upright rectangular structural member, and a front flange projecting inwardly from a junction between the back edge of each central panel and mounting bracket for seating the display holder at a proper depth against the upright structural member.

4. The display holder of claim 1, wherein the outer frame strip and the back edge frame strips form slots along the outer and back edges of the panels, for receiving the side edges of displays and holding the displays on the panels.

5. The display holder of claim 1, further comprising top and bottom edge caps adapted to mount to the top and bottom edges, respectively, of the first and second central panels, the top and bottom edge caps providing a top frame portion and a bottom frame portion, respectively, for the panels.

6. The display holder of claim 5, wherein the top and bottom edge caps are adapted to be press-fitted onto the top and bottom edges, respectively, of the panels.

7. The display holder of claim 5, wherein the top and bottom edge caps each are sufficiently flexible to accommodate angular deflection between the central panels.

8. The display holder of claim 7, wherein the top and bottom edge cap each are V-shaped to correspond with the cross-sectional shape of the central panels, and wherein the junctions of the V-shaped top and bottom edge caps are formed of a flexible material and arms of the top and bottom edge caps are made of a rigid material.

9. The display holder of claim 8, wherein the junctions of the V-shaped top and bottom edge caps are formed of a flexible material by injection molding a flexible material into the regions of the junctions, and the arms of the top and bottom edge caps are made of a rigid material by injection molding a rigid material into the regions of the arms, wherein the junctions have sufficient flexibility to bend while the arms remain relatively rigid.

10. The display holder of claim 5, wherein the top edge cap has a rounded top surface, and the bottom edge cap has a rounded bottom surface, and the junctions of both edge caps are rounded, so as to provide a display holder without any exposed sharp edges.

11. A display holder adapted to be vertically mounted to an upright structural member, comprising:

first and second central panels joined together along and outer side edge of each panel to form a main body section that is substantially V-shaped in cross-section, the first and second central panels being joined in manner allowing the panels to be angularly deflected, the first and second central panels also each including a back side edge, wherein angular deflection of the panels causes the back side edges to move toward and away from each other, thereby changing the distance between the back edges, the first and second central panels each adapted to receive a display, an outer frame strip at the junction of the first and second central panels and providing a frame portion along the outer edges of the panels, and a back edge frame strip at the back edge of each central panel and providing a frame portion along the back edges of the panels, the outer frame strip and the back edge frame strips defining a channel on each panel for receiving a display, and, a mounting bracket at the back edge of each central panel for securing the panels to lateral sides of the upright structural member, wherein the mounting brackets and both central panels are formed as an integral unit and from a material that has sufficient flexibility to allow angular deflection between the mounting brackets and the back edges of the panels, and between the two panels, and whereby the display holder can be secured to upright structural members of varying widths by angularly deflecting the central panels to change the spacing between the mounting brackets to correspond to the lateral width of the upright structural member, wherein the mounting brackets each are secured to the back edges of the panels in a manner so that the mounting brackets can be angularly deflected relative to the panels, whereby the mounting brackets can be aligned with the lateral sides of the upright structural member regardless of the width of the upright structural member, further comprising a strip of relatively flexible material joining together the first and second panels, the first and second panels being made of relatively more rigid material.

12. The display holder of claim 11, wherein said strip of relatively flexible material is formed by coextrusion with the central panels.

* * * * *

UNITED STATES PATENT AND TRADEMARK OFFICE

CERTIFICATE OF CORRECTION

PATENT NO. : 5,560,131

DATED : October 1, 1996

INVENTOR(S) : Scott S. Gibson

It is certified that error appears in the above-indentified patent and that said Letters Patent is hereby corrected as shown below:

Column 2, line 23, "stuctural" should be -- structural --.

Column 4, line 2, "structral" should be -- structural --.

Column 5, line 53, delete "10.".

Column 6, line 34, "equivalence" should be -- equivalents --.

Claim 1, column 6, lines 39 and 46, "and" (2nd occur.) should be --an--.

Claim 1, column 6, lines 42 and 49, after "in", insert -- a --.

Claim 1, col. 7, line 5, "panels,and" should be -- panels, and --.

Claim 11, column 8, line 10, "and" (2nd occur.) should be --an--.

and in line 13, after "in", insert -- a --.

Signed and Sealed this

Thirty-first Day of December, 1996

*Attest:*

Bruce Lehman

BRUCE LEHMAN

*Attesting Officer*

*Commissioner of Patents and Trademarks*